United States Patent [19]

Farrar et al.

[11] Patent Number: 4,769,245

[45] Date of Patent: Sep. 6, 1988

[54] PACKAGING PROCESS FOR BAKED GOODS

[75] Inventors: Patricia A. Farrar; James C. Patton, both of Dallas; Kathy L. Sullivan, Coppell; Eugene E. Wisakowsky, Royse City; David L. Dewberry, Dallas, all of Tex.

[73] Assignee: Campbell Taggart, Inc., Dallas, Tex.

[21] Appl. No.: 927,256

[22] Filed: Nov. 4, 1986

[51] Int. Cl.[4] ..... A23B 9/00

[52] U.S. Cl. ..... 426/106; 426/118; 426/410; 426/411

[58] Field of Search ..... 426/106, 118, 128, 392, 426/395, 396, 324, 410, 415; 229/87.13

[56] References Cited

U.S. PATENT DOCUMENTS

| | | |
|---|---|---|
| 3,870,806 | 3/1975 | Caposella et al. . |
| 3,900,161 | 8/1975 | Blackman . |
| 3,914,917 | 10/1975 | Young . |
| 4,099,666 | 7/1978 | Welles . |
| 4,112,122 | 9/1978 | Long . |
| 4,157,403 | 6/1979 | Schiffmann et al. . |
| 4,217,693 | 8/1980 | Roder et al. . |
| 4,226,358 | 10/1980 | Ottow . |
| 4,250,802 | 2/1981 | Rubio . |
| 4,283,427 | 8/1981 | Winters et al. . |
| 4,285,979 | 8/1981 | Izzi . |
| 4,357,356 | 11/1982 | Joulin . |
| 4,366,178 | 12/1982 | Reynolds et al. . |
| 4,372,982 | 2/1983 | Haasl et al. . |
| 4,416,903 | 11/1983 | Cole . |
| 4,448,791 | 5/1984 | Fulde et al. . |
| 4,456,625 | 6/1984 | Durst . |
| 4,457,124 | 7/1984 | Hartmann . |
| 4,500,145 | 2/1985 | Fassauer . |
| 4,511,585 | 4/1985 | Durst . |
| 4,512,137 | 4/1985 | Koberlein . |

FOREIGN PATENT DOCUMENTS

| | | | |
|---|---|---|---|
| 1008679 | 11/1965 | United Kingdom | 426/128 |
| 1075455 | 7/1967 | United Kingdom | 426/128 |

*Primary Examiner*—Barry S. Richman
*Assistant Examiner*—William R. Johnson
*Attorney, Agent, or Firm*—Richards, Harris, Medlock & Andrews

[57] ABSTRACT

A method of packaging baked goods for commercial distribution is particularly suitable for brown and serve bakery products, which are more suscepticle to microbiological spoilage than fully baked products, and especially for brown and serve french bread, because the method alleviates the need for the addition of microbiological inhibitors while maintaining high product quality, the characteristics of European-style bread and long shelf life. Such advantages are achieved by packaging the product, while hot enough to inactivate microbial organisms, in a specially adapted container.

26 Claims, 1 Drawing Sheet

PACKAGING PROCESS FOR BAKED GOODS

TECHNICAL FIELD

This invention relates to a process of packaging baked goods, and more particularly to a method of packaging brown and serve french bread without microbiological inhibitors.

BACKGROUND OF THE INVENTION

Baked bread and rolls including brown and serve products, have relied on microbiological inhibitors such as those derived from proprionic acid and sorbic acid to enhance shelf life. Microbiological inhibitors are objectionable because many consumers are resistant to purchasing products containing them. In addition, it has been found that the use of microbiological inhibitors results in a substantial loss of the characteristic and highly desirable attributes of flavor and texture found in these breads. Brown and serve beads is highly susceptible to microbiological spoilage. Mold growth is of special concern since the product will display mold growth within such a short period of time after baking, that normal commercial distribution cannot be achieved, without the use of microbiological inhibitors. Also, large scale distribution of french bread has been thwarted because of the degree to which the product quality suffers when microbiological inhibitors were added in quantities previously thought necessary to extend shelf life for commercial distribution.

SUMMARY OF THE INVENTION

It is accordingly an object of the invention to provide baked goods, including brown and serve breads which have the desirable qualities of fresh goods and extended shelf life.

It is another object of the present invention to provide baked bread and rolls, including brown and serve products, which do not incorporate microbiological inhibitors.

It is yet another object of the present invention to provide a brown and serve bread product with authentic flavor, aroma, color, texture and appearance.

It is a further object of the present invention to provide a method for achieving the above-stated objectives.

These and other objects of the present invention are met by providing a dough mixture without microbiological inhibitors, baking the dough and rapidly transferring the baked product into specially adapted packaging.

DESCRIPTION OF THE PREFERRED EMBODIMENTS

Figure 1:
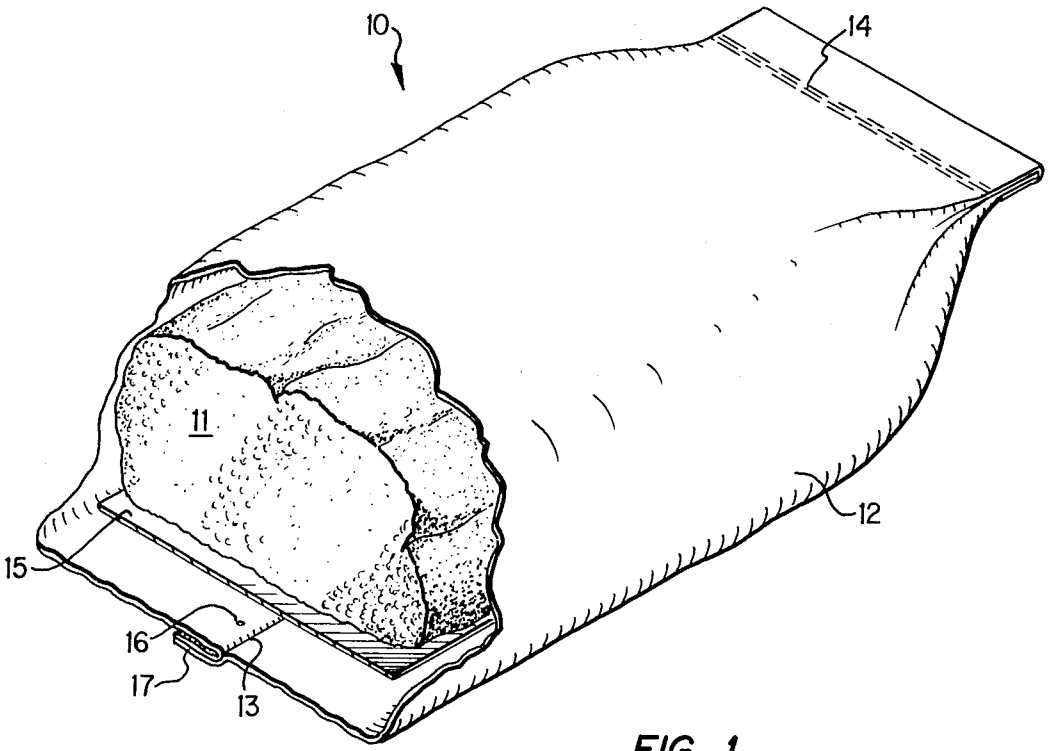
FIG. 1 shows an isometric cross-sectional view, partially broken away, of a packaged french bread, prepared in accordance with the teachings of the present invention.

The following description is intended to provide a reliable and reproducible brown and serve french bread recipe by straight dough method.

1. Ingredients

The following table lists the various ingredients from which a brown and serve dough is made. While this formula may be somewhat typical for fresh baked goods, it is notable amongst brown and serve formulas for not containing microbiological inhibitors. It is provided as an example:

| INGREDIENTS | WEIGHT lbs. |
|---|---|
| Bulk Bread Flour | 600 |
| Water (chilled) | 330 |
| Yeast Slurry | 18 |
| 200 Grain Vinegar | 4½ |
| Salt | 12 |
| TOTALS | 964½ |

Depending upon the flour used, dough relaxants and/or oxidizers may be necessary. Thereafter, employ production methods standard in the industry.

About 836 loaves may be divided from this dough mixture.

2. Packaging

FIG. 1 shows an example of the special packaging 10 of the present invention.

In order to obtain maxiumum shelf life in this product, special packaging procedures must be observed. Because this product contains no microbiological inhibitors, the product must be packaged hot in order to obtain satisfactory shelf life.

Exposure time is defined as the time required for the product to exit the hot oven and become enclosed within a package. Because the product cools during exposure, exposure time must be limited to prevent microbiological contamination. Minimum temperatures have been experimentally determined, below which the product must not fall prior to packaging. Satisfactory exposure time depends on (1) surface temperature and latent heat of the product exiting from the oven and (2) the microorganism count in the environment surrounding the product from the oven through the packaging operation. The microorganisms of greatest concern are mold spores and wild yeasts. Latent heat in and around the hot goods inactivates microbiological organisms such as mold spores contacting the product between the oven and final packaging operation. In this example, a practical exposure time of 40–50 seconds has been shown to result in a loaf top temperature of 185°±5° F., loaf bottom temperature of 200±10° F. and internal temperature of 207±2° F.

The final packaging machine must be located near enough to the oven exit to allow the loaves to be packaged while still sufficiently hot to be lethal to microbiological organisms. A Fuji brand "horizontal form and fill" machine may be used. It uses roll stock heat sealable film such as Crown #2021 opaque high density polyethylene, 1½ mil. thickness, available from Crown Advanced Films, Plano, Tex.

As seen in FIG. 1, the hot loaves 11 are heat sealed within the film 12 having horizontal 13 and vertical seams 14. It should be noted that conventional bagging equipment creates air currents around the product that increase the likelihood of contamination by airborne organisms and negatively affect shelf life.

Solid bleached sulfite board 15, clay-coated and sterilized, is placed under the hot loaf before sealing the package. Other sterile, moisture resistant carriers are suitable. The sterilized board prevents heat damage to the package film from the hot bread and also helps prevent microbiological spoilage as will be further explained.

Because the package is intended to prevent excess microbiological exposure, the seals created by the packaging machine should be tight. If the package were completely sealed, however, on cooling, contraction of the hot air in the package would create a vacuum causing partial crushing of the finished loaf or bread product. To avoid this, a minute filter hole or aperture 16 or apertures are formed on the bottom of the package. The filter hole or aperture or apertures constitute an equilibrating means which allow the package to "breathe" without admitting an excess of microbes. Equilibration of pressure between the interior and exterior of the package eliminates the possibility of product damage. In this example, a single aperture, generally 0.15 mm to 0.40 mm in diameter, should be located on the film beneath the sterilized board. The aperture should be beneath the longitudinal flap 17 produced by the packaging machine. In this way, air entering the package does not impinge directly on the bread product as it cools. In addition to acting as a heat shield, the board thus acts as a barrier to contaminants in the air.

It should be noted that the loading of the hot loaves from the oven into the loading tracks of the packaging machine constitutes the only area in which the unpackaged product should be handled. The transfer should be made automatically or by skilled workers using sanitized gloves. If the product is mishandled during this step, shelf life is decreased.

3. Handling and Distribution

The product may be frozen for shipment to remote distribution centers.

While we have described above the principles of our invention in connection with specific process steps, materials and equipment, it is to be clearly understood that this description is made only by way of example and not as a limitation to the scope of our invention as set forth in the objects thereof and in the accompanying claims.

What is claimed is:

1. A method of preparing baked goods, free from microbiological inhibitors, comprising the steps of:

preparing a dough which is free from microbiological inhibitors;

baking the dough;

transferring the hot baked product from the oven to a packaging machine quickly, while the product is still hot;

placing a shielding medium between the still hot product and a packaging material;

immediately wrapping and sealing in the hot product; and providing pressure equilibrating means in the packaging.

2. The method of claim 1, wherein:

transferring the hot baked product to a packaging machine is accomplished in less than 50 seconds.

3. The method of claim 2, wherein:

transferring the hot baked product to a packaging machine is accomplished while the product temperature is sufficiently high to inactivate undesirable microbiological organisms.

4. The method of claim 3, wherein:

the pressure equilibrating means comprises one or more apertures.

5. The method of claim 4, wherein:

the shielding medium comprises a thin, sterile, moisture proof carrier.

6. the method of claim 5, wherein:

the equilibrating means is located beneath the shielding medium.

7. The method of claim 6, wherein:

the equibrating means comprises a single aperture, between 0.15 and 0.40 mm in diameter.

8. The method of claim 3, wherein:

the packaging material has formed therein a longitudinal seal having a flap and the equilibrating means is located between the flap and the shielding medium.

9. The method of claim 8, wherein the equilibrating means further comprises one or more apertures.

10. The method of claim 9, wherein:

the equilibrating means further comprises an aperture between 0.15 and 0.40 mm in diameter.

11. A packaged baked good free from microbiological inhibitors comprising:

a wrapper sealed but for having a pressure equilibrating means formed therein;

a separate barrier located within the wrapper; and a baked good located within the wrapper and on top of the barrier.

12. The packaged baked good of claim 11, wherein:

the wrapper is sealed but for a single aperture located beneath the barrier.

13. The packaged baked good of claim 12, wherein:

the aperture is between 0.15 and 0.40 mm in diameter.

14. The packaged baked good of claim 13, wherein:

the baked good is a brown and serve baked good, free from mold inhibitors.

15. The packaged baked good of claim 14, wherein:

the separate barrier comprises a sterile, moisture proof carrier.

16. The packaged baked good of claim 11, wherein:

the wrapper further comprises a seal having a flap, the equilibrating means located between the flap and the barrier.

17. The packaged baked good of claim 16, wherein:

the equilibrating means comprises one or more apertures.

18. The packaged baked good of claim 17, wherein:

the equilibrating means further comprises a single aperture, between 0.15 and 0.40 mm in diameter.

19. A method of providing brown and serve baked goods, free from microbiological inhibitors comprising the steps of:

preparing a dough which is free from microbiological inhibitors;

baking the dough;

transferring the hot baked product from the oven to a nearby packaging machine while the product temperature is sufficiently high to inactivate undesirable microbiological organisms;

placing a thin, sterilized, moisture resistant carrier beneath the baked good; and immediately wrapping the hot product in a sealed wrapper having a single aperture formed therein, the wrapper having a seal further including a flap, wherein the aperture is located directly between the sterilized carrier and the flap.

20. The method of claim 19 wherein:

the aperture is between 0.15 and 0.40 mm in diameter.

21. A package for containing baked goods, comprising:

a wrapper, impervious to air and moisture but for a single filter hole formed in the wrapper, the filter hole having a diameter of 0.15–0.40 mm;

the package further comprising a thin moisture-proof barrier, within the wrapper and beneath the baked goods.

22. The package of claim 21, wherein the wrapper further comprises a seal forming a flap, the flap adapted to lie over the filter hole.

23. The package of claim 22, wherein the filter hole is located between the thin barrier and the flap.

24. A package for containing baked goods, comprising:

a wrapper, impervious to air and moisture, but for two or more filter holes, formed in the wrapper, the filter holes each having a diameter of 0.15–0.40 mm;

the package further comprising a thin moisture-proof barrier, within the wrapper and beneath the baked goods.

25. The package of claim 24, wherein the wrapper further comprises a seal forming a flap, the flap adapted to lie over one or more of the filter holes.

26. The package of claim 25, wherein the filter holes are located between the flap and the moisture-proof barrier.

* * * * *